US006847273B2

(12) United States Patent
Shin-Hsuan et al.

(10) Patent No.: US 6,847,273 B2
(45) Date of Patent: Jan. 25, 2005

(54) MINIATURIZED MULTI-LAYER COPLANAR WAVE GUIDE LOW PASS FILTER

(75) Inventors: Tseng Shin-Hsuan, Shindian (TW); Lin Cheng-Kuo, Jungli (TW); Wang Yin-Ching, Banchiau (TW); Huang Fan-Hsiu, Taipei (TW); Chan Yi-Jen, Jungli (TW)

(73) Assignee: Cyntec Co., Ltd., Hsinchu (TW)

( * ) Notice: Subject to any disclaimer, the term of this patent is extended or adjusted under 35 U.S.C. 154(b) by 0 days.

(21) Appl. No.: 10/422,692

(22) Filed: Apr. 25, 2003

(65) Prior Publication Data

US 2004/0212461 A1 Oct. 28, 2004

(51) Int. Cl.[7] ..... H01P 1/203

(52) U.S. Cl. ..... 333/204; 333/161; 438/205; 438/622

(58) Field of Search ..... 333/204, 157, 333/158, 161; 438/250, 251, 622, 624

(56) References Cited

U.S. PATENT DOCUMENTS 5,387,888 A * 2/1995 Eda et al. ..... 333/247
5,706,022 A * 1/1998 Hato ..... 345/92
6,170,154 B1 * 1/2001 Swarup ..... 29/830
6,174,803 B1 * 1/2001 Harvey ..... 438/638
6,465,297 B1 * 10/2002 Henry et al. ..... 438/238
6,660,618 B1 * 12/2003 Chen et al. ..... 438/584

* cited by examiner

*Primary Examiner*—Timothy P. Callahan
*Assistant Examiner*—An T. Luu
(74) *Attorney, Agent, or Firm*—Troxell Law Office PLLC

(57) ABSTRACT

The present invention discloses a miniaturized multi-layer coplanar wave guide low pass filter including: a substrate; a first dielectric layer formed on and enclosing said substrate; a first metallic pattern layer formed on said first dielectric layer; a second dielectric layer formed on said first metallic pattern layer; wherein several via holes being formed on said second dielectric layer; a second metallic pattern layer formed on said second dielectric layer, wherein said via holes formed on said second dielectric layer are filled up with the metal thereof; a third dielectric layer formed on said second metallic pattern layer, wherein several via holes being formed on said third dielectric layer; and a third metallic pattern layer formed on said third dielectric layer, wherein said via holes formed on said third dielectric layer are filled with the metal thereof.

4 Claims, 9 Drawing Sheets

MINIATURIZED MULTI-LAYER COPLANAR WAVE GUIDE LOW PASS FILTER

BACKGROUND OF THE INVENTION

1. Field of the Invention

The present invention relates to a miniaturized multi-layer coplanar wave guide low pass filter, and more particularly, to a miniaturized multi-layer coplanar wave guide low pass filter which is capable of enlarging the region of the characteristic impedance of a transmission line and miniaturizing the size of a filter by utilizing a multi-layer coplanar wave guide.

2. Description of the Prior Art

As it is well known, a filter is essentially composed of series inductors and parallel capacitors.

A low pass filter plays an important role on the microwave circuit, and is used to eliminate noises in a frequency change over circuit. However, the operation frequency in a new generation mobile communication system has been raised up to 30 GHz and above so as to cope with the trend of rapid development of the modern radio communication technology, and the design of transmission and distribution mode should be considered to operate the electromagnetic wave having the frequency 30 GHz and above.

For achieving the aforesaid object, the design of a well-known coplanar wave-guide structure which has been presented by Mr. C. P. Wen in 1969 is used. Its basic construction is shown in FIG. 1 in which the conductor and the grounding plate are made of a metal including gold, copper, etc. Meanwhile, the normal size of T.H.G.H is remained uncertain and is left it to the manufacture's decision, thereby having the merits of obtaining a simple coplanar structure with other active components, and omitting the processes of backside metallization and via hole forming so as to facilitate the fabrication process. Besides, the characteristic impedance is determined by the proportion of width between vacant slot and signal wire so that its electrical properties are less influenced by the thickness of the substrate. Moreover, as it is a real simple coplanar structure whose transmission line, signal wire, and ground wire is in the same plane so that cascading and paralleling among circuits can be easily performed by omitting formation of extra via holes which is necessary in a microstrip transmission line. The above mentioned via holes tend to bring about innegligible inductance effect at high frequency resulting in reducing efficiency of the circuit. Eliminating vertical via holes not only leads to reduction of circuit fabrication cost, but also enables to improve the selectivity of the circuit layout.

In bygone time, the two dimensional mode is usually employed when designing a coplanar wave guide low pass filter as shown in FIG. 2, wherein the equalizing potential among metal parts is mainly performed by means of bonding or air bridging. However, it is found to be impracticable as the area occupied by these circuits is considerably large. Therefore, it is an urgent matter as to effectively minimizing the area occupied by a circuit when designing a low pass filter. Accordingly, the inventor of the present invention disclosed a two-dimensional coplanar wave guide low pass filter based on the principle of step type impedance as shown in FIG. 3. It can be seen that such a two-dimensional coplanar wave guide low pass filter has a merit capable of saving process of bonding and forming air bridges among metal parts. Furthermore, for an equivalent circuit, a five order low pass filter was disclosed according to Butterworth model as shown in FIG. 4.

In the meanwhile, it is found the area of this two-dimensional coplanar wave guide low pass filter is still unable to be reduced to a satisfactory extent which complies with the compactness of light, thin, short, and small that fulfils the current radio communication system's needs.

In addition, the conventional coplanar wave guide filter has a characteristic impedance in the range of 50~70Ω which is considered one of the disadvantages when it is to be in match with the network.

Aiming at the above-depicted defects, the present invention is to propose an innovative miniaturized multi-layer coplanar low pass filter after long time efforts made by the present inventor which is capable of eliminating the disadvantages inherent to the conventional products.

SUMMARY OF THE INVENTION

Accordingly, it is a first object of the present invention to provide a low pass filter which can greatly reduce the area occupied by the filter so as to fulfill the current radio communication system's needs of light, thin, short, and small structure.

It is a second object of the present invention that the provided low pass filter is a miniaturized multi-layer coplanar wave guide low pass filter whose metallic parts, substrate material, and dielectric material are all incorporated to greatly enlarge the region of its characteristic impedance.

It is a third object of the present invention to provide a miniaturized multi-layer coplanar low pass filter which can be fabricated by thin film fabrication technology therefore not only capable of achieving the product compactness but also greatly reducing the time and cost for production so as to strengthen the competitive ability in the market.

It is a fourth object of the present invention to provide a miniaturized multi-layer coplanar low pass filter whose applicable range of its characteristic impedance is greatly widened so as to facilitate this filter to match with the network.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PREFERRED EMBODIMENTS

The structure and shortcomings of the conventional two-dimensional coplanar wave guide low pass filter have already been illustrated above therefore will not be described herein again.

Figure 1:
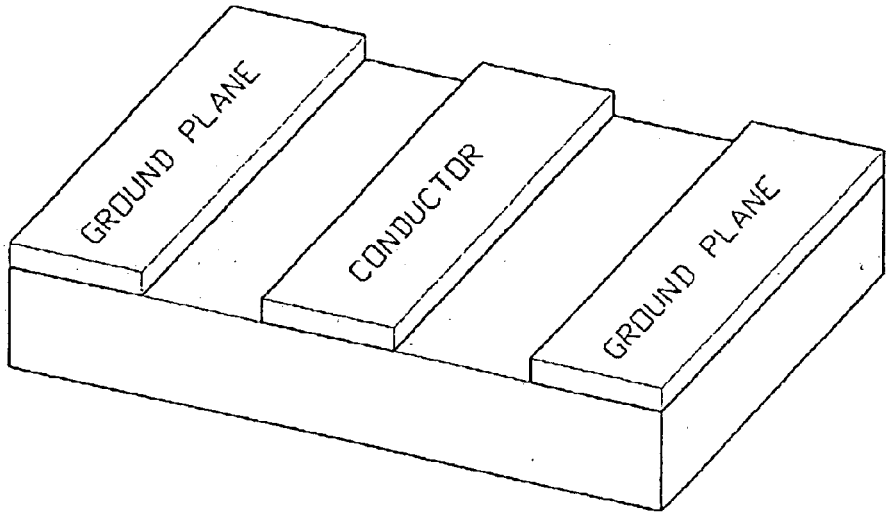
FIG. 1 is a schematic view of a basic coplanar wave guide structure.
Figure 2:
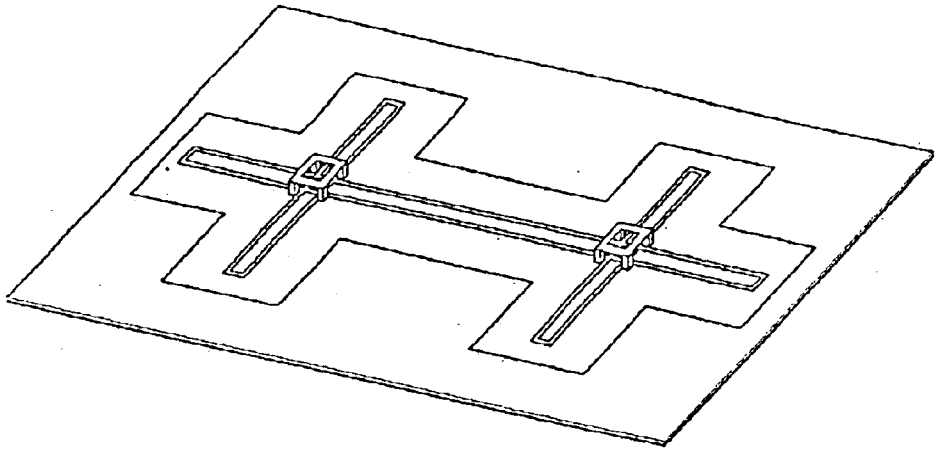
FIG. 2 is a schematic view of a coplanar wave guide low pas filter fabricated according to two-dimensional mode.
Figure 3:
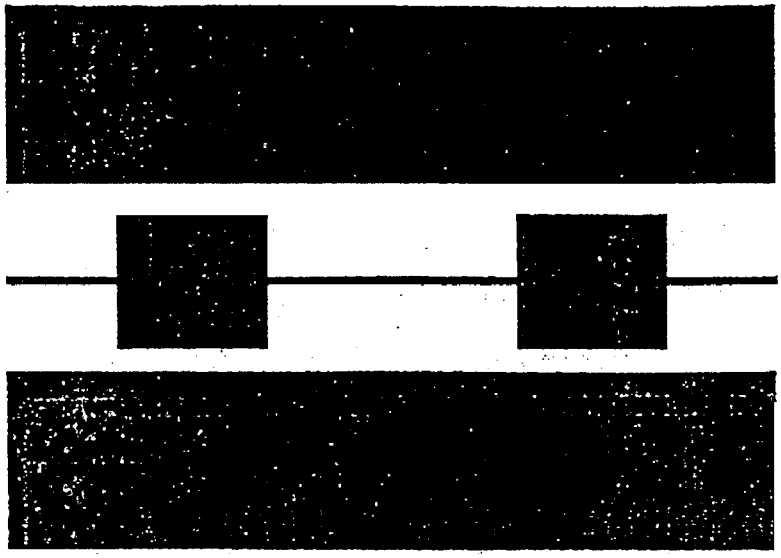
FIG. 3 is a schematic view of a two-dimensional coplanar wave guide low pass filter designed according to the principle of step type impedance.
Figure 4:
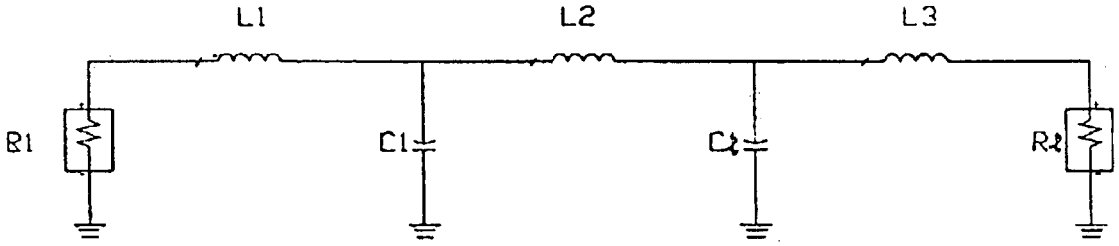
FIG. 4 is an equivalent circuit for a five order low pass filter designed according to Butterworth Model.
Figure 5:
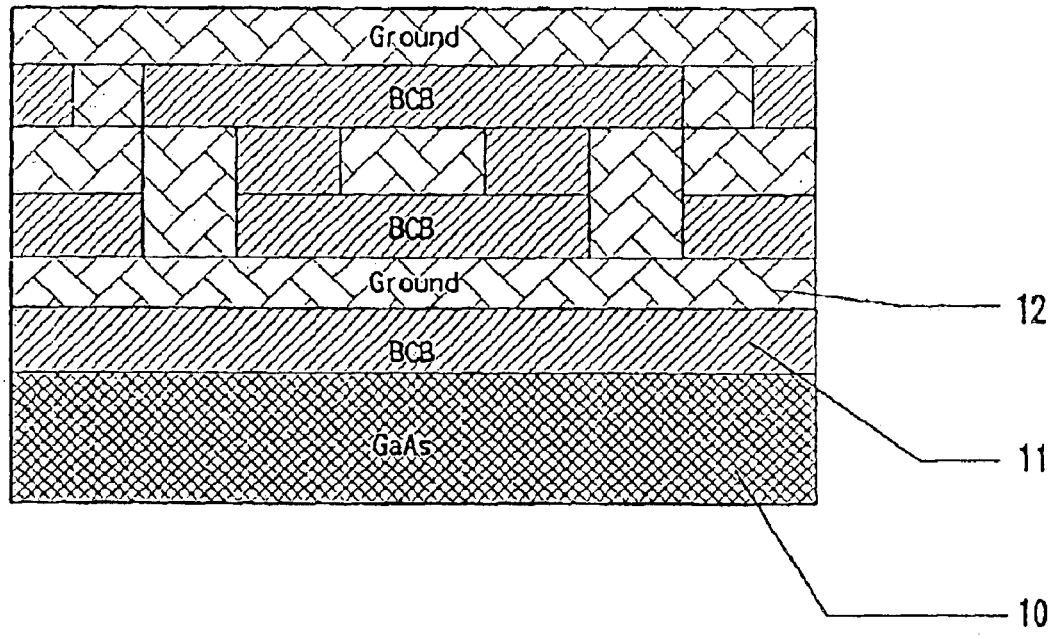
FIG. 5 is a cross-sectional view of the miniaturized multi-layer coplanar wave guide low pass filter according to the present invention.

Referring to the equivalent circuit for a five order low pass filter according to the present invention shown in FIG. 4, and its structure shown in FIG. 5, the equivalent circuit includes three inductances L1, L2, and L3 connected in series, and two capacitance C1, C2 connected in parallel. The structure thereof shown in FIG. 5 includes a substrate 10 preferably made of $Al_2O_3$ with $\Sigma r=9.8$, and a thickness of preferably 200~350 $\mu$m; a first dielectric layer 11 enclosed over the substrate 10, the dielectric layer 11 is preferably made of Benzocyclobutene having a low dielectric constance ($K\approx2.6$), a low tangential loss ($\tan\theta\approx0.002$), and a preferable thickness of 2~3 $\mu$m, in addition to the property of low dielectric constant and low tangential loss, it should be of good adhesiveness with the metallic materials and the substrate of negative photoresistivity, suitable for drilling via holes and forming into multi-layer structure, a first metallic pattern layer 12 (see FIG. 6A) formed on the first dielectric layer 11, preferably made of gold with a thickness less than 1.5 $\mu$m; then a second dielectric layer 13, a second metallic pattern layer 14, a third dielectric layer 15, and a third metallic pattern layer 16 are formed on the first metallic pattern layer 12 in order, wherein the second and third dielectric layers 13, 15 are made of similar material with, and have the equal thickness to the first one 11, while the second and third metallic pattern layers 14, 16 are made of the similar material with, and have the equal thickness to the first one 12, the only difference between the two pattern layers 14, 16 from the first metallic pattern layer 12 are shown in FIGS. 6B and 6C.

Figure 6A:
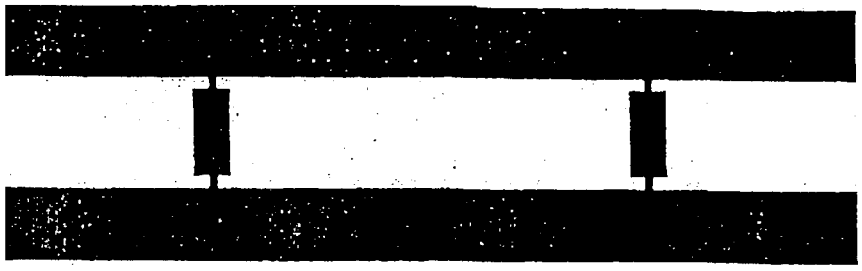
FIG. 6A~6C are schematic views showing three different metallic pattern layers.
Figure 6B:
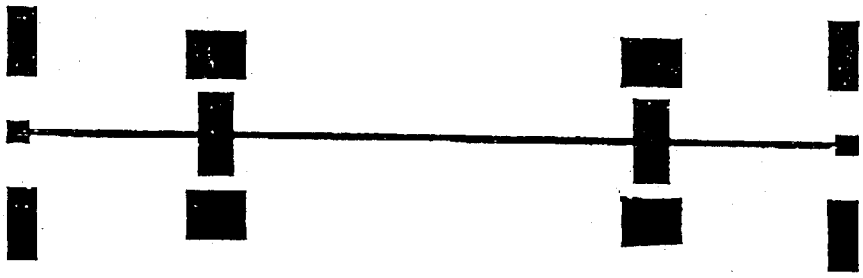
Figure 6C:
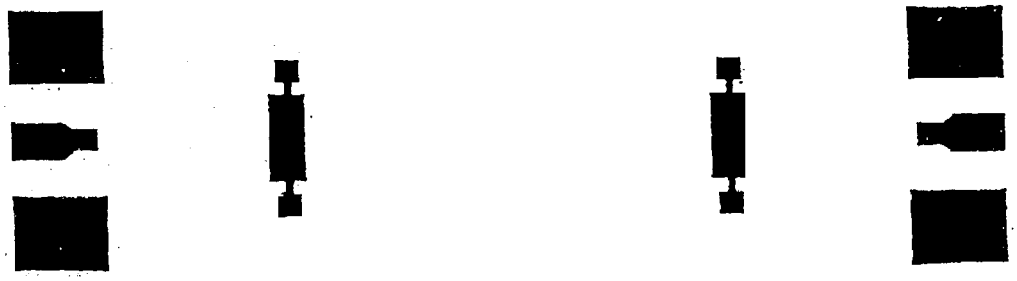
Figure 7A:
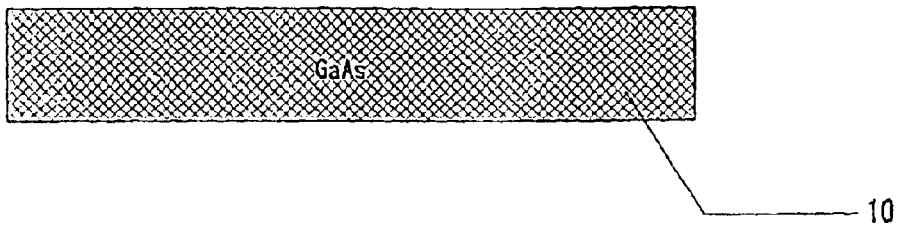
FIG. 7A~7G are cross-sectional views illustrating fabrication steps of the present invention.
Figure 7B:
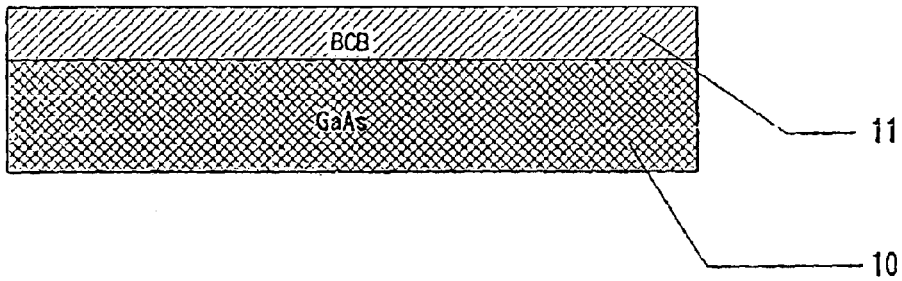
Figure 7C:
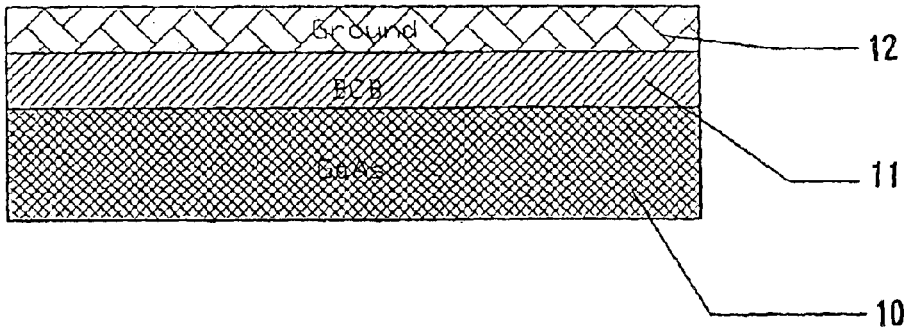
Figure 7D:
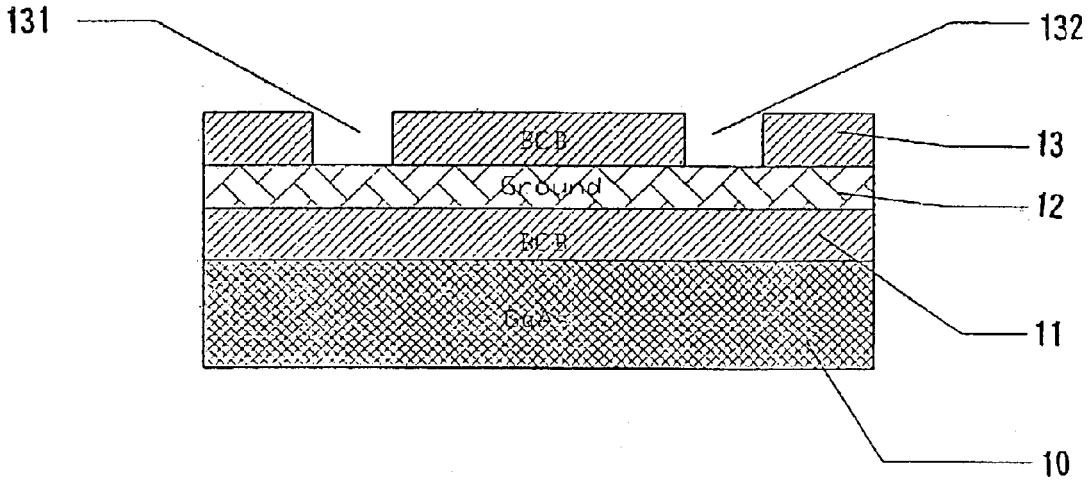
Figure 7E:
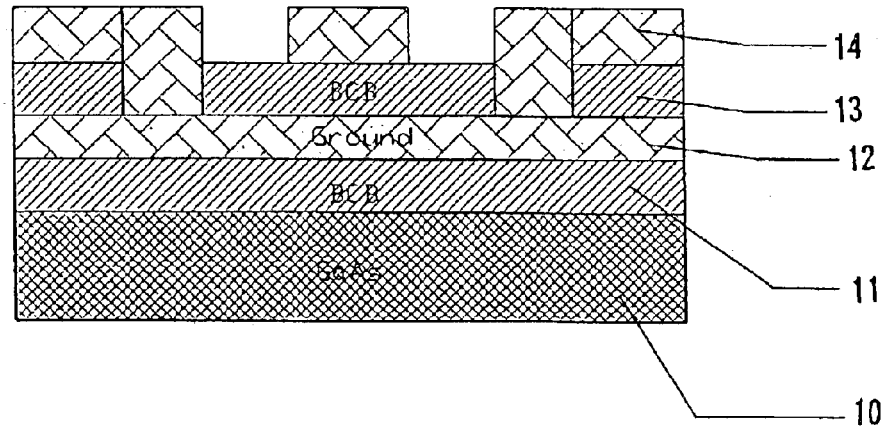
Figure 7F:
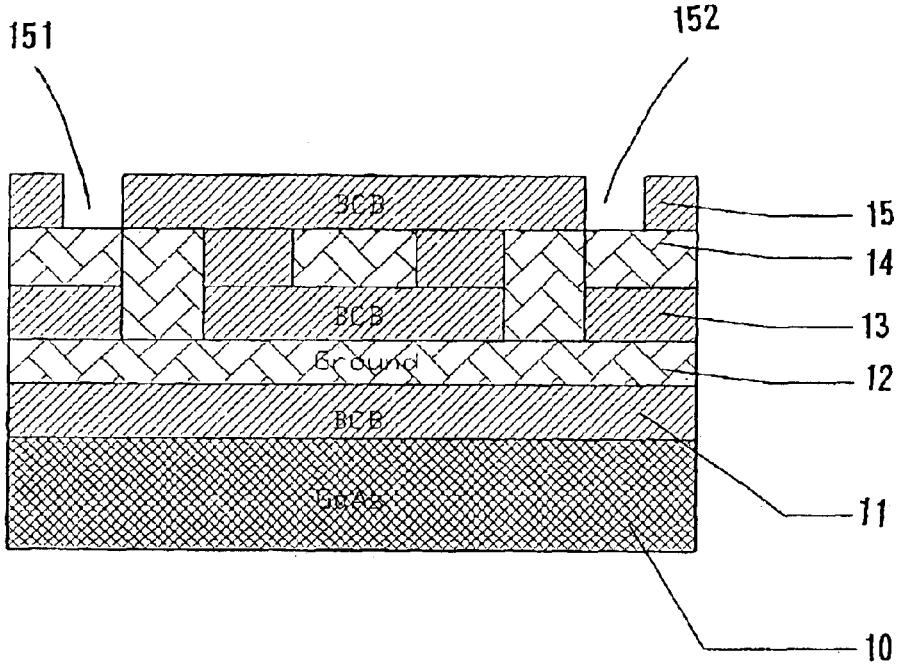
Figure 7G:
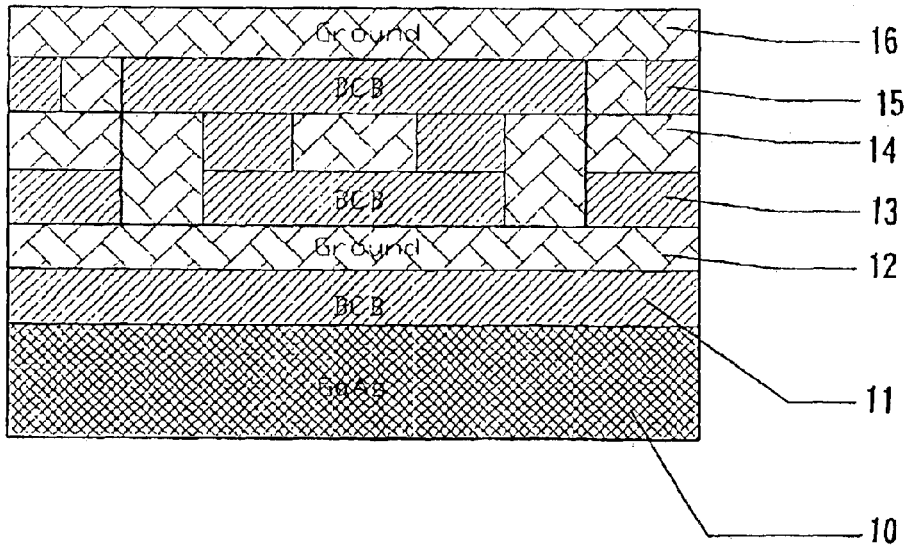

The fabrication steps of the present invention are illustrated in FIGS. 7A to 7G. The steps comprise:

(a) providing a substrate 10 made of the material described above, it may be GaAs, $Al_2O_3$, $FR_4$ etc., preferably $Al_2O_3$;

(b) enclosing a first dielectric layer 11 over the substrate 10, the material to be used for the layer 11 is preferably Benocycolobutene;

(c) forming a first metallic pattern 12 on the first dielectric layer 11, the material to be used for the layer 12 is preferably gold with a pattern shown in FIG. 6A;

(d) enclosing a second electric layer 13 over the first metallic pattern layer 12, material to be used for the layer 13 is preferably benzocyclobutene, and forming via holes 131, 132 using a developer after exposure;

(e) forming a second metallic pattern layer 14 on the second dielectric layer 13, and filling up the via holes 131, 132 which have been previously formed on the second dielectric layer 13;

(f) forming a third dielectric layer 15 on the second metallic pattern layer 14 using the similar material as that of the first and second dielectric layers 11, 13, and forming via holes 151, 152 using a developer after exposure; and (g) forming a third metallic pattern layer 16 on the third dielectric layer 15, and filling up the via holes 151, 152 which have been previously formed on the third dielectric layer 15.

Figure 8:
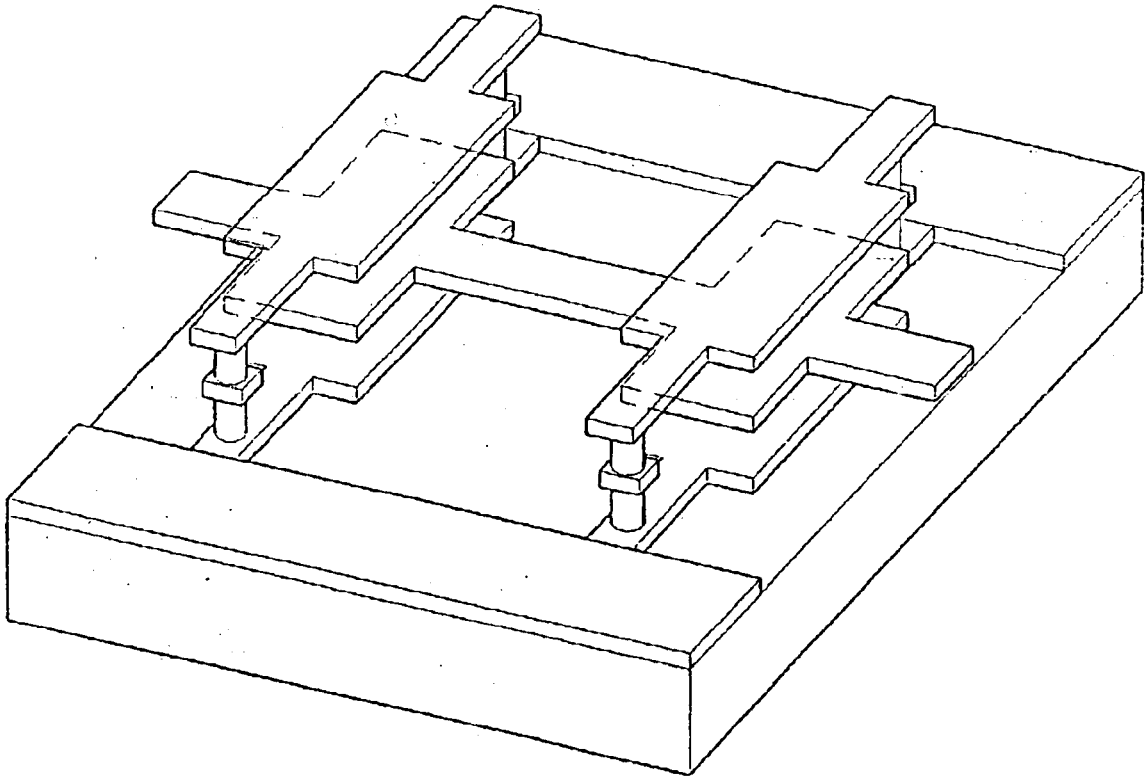
FIG. 8 is a three-dimensional view of the miniaturized multi-layer coplanar wave guide low pass filter according to the present invention.

The resultant three dimensional structure of the miniaturized multi-layer coplanar wave guide low pass filter of the present invention formed by above described steps is shown in FIG. 8.

Figure 9:
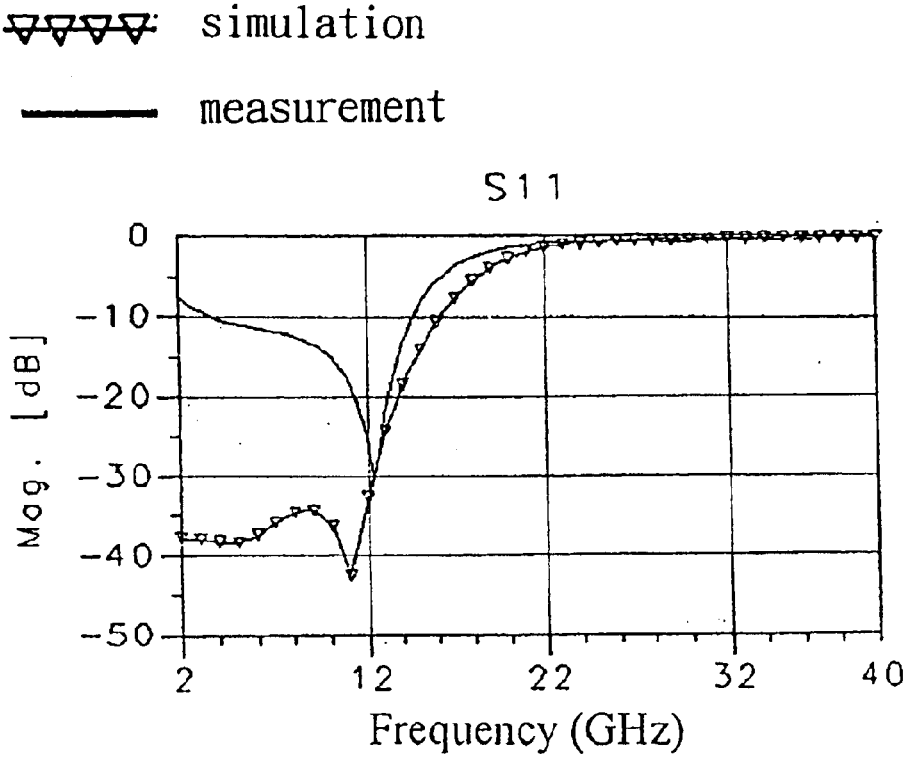
FIG. 9 is a graph showing the deviation in return loss of the present invention between computer simulation and actual measurement.
Figure 10:
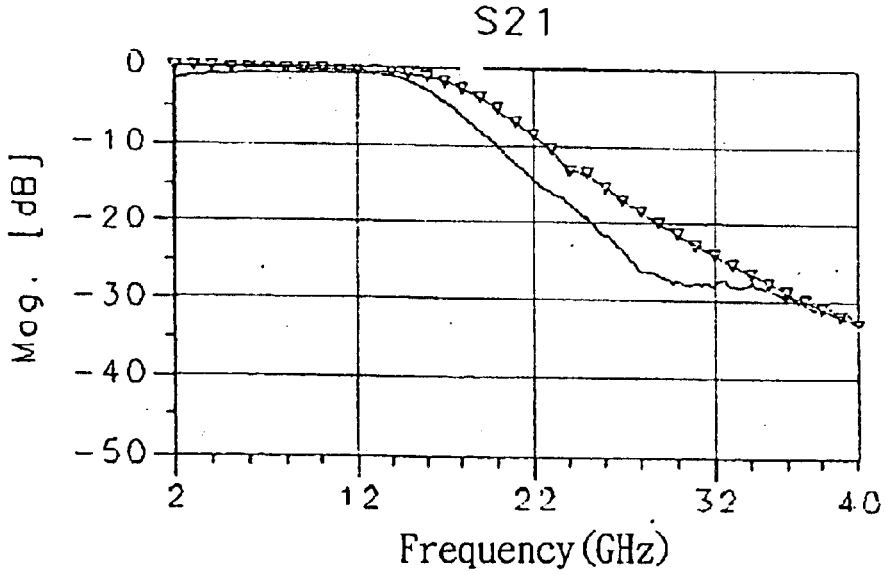
FIG. 10 is a graph showing the deviation in dielectric loss of the present invention between computer simulation and actual measurement.

It can be seen from the above description that the miniaturized multi-layer coplanar wave guide low pass filter has some noteworthy features, i.e.:

1. A low dielectric constant ($\Sigma r=2.6$), a low tangential loss ($\tan\delta=0.002$) can be realized by using benzocyclobutene as the dielectric material. Moreover, using gold as the metal layer results in a good conductivity ($\delta=4.117$) and an excellent ductility. The above two factors combined to cause the filter of the present invention to have a good conducting and small size whose overall thickness is as thin as below 15 $\mu$m.
2. Application of multi-layer coplanar wave guide results in enlarging the region of the characteristic impedance of the transmission line and reducing the size of the filter as well. The characteristic impedance is in the range 3 $\Omega$~103$\Omega$.
3. The results of simulated and actually measured return loss and dielectric loss shown respectively by the graphs of FIG. 9 and FIG. 10 prove the fact that the circuit characteristic of the filter according to the present invention attains the expected effect practically suitable for industrial application.

A variety of modifications and variations of the present invention are possible in light of the above teachings. It is therefore to be understood that within the scope of the appended claims, the present invention may be practiced otherwise than as specially described hereinabove.

What is claimed is:

1. A miniaturized multi-layer coplanar wave guide low pass filter comprising:

a substrate;

a first dielectric layer formed on and enclosing said substrate;

a first metallic pattern layer formed on said first dielectric layer;

a second dielectric layer formed on said first metallic pattern layer, wherein several via holes are formed on said second dielectric layer;

a second metallic pattern layer formed on said second dielectric layer, wherein said via holes formed on said second dielectric layer are filled up with the metal of the second metallic pattern layer;

a third dielectric layer formed on said second metallic pattern, wherein several via holes are formed on said third dielectric layer; and a third metallic pattern layer formed on said third dielectric layer, wherein said via holes formed on said third dielectric layer are filled up with the metal of the third metallic pattern layer, the first dielectric layer, the second dielectric layer and the third dielectric layer having equal thicknesses.

2. The low pass filter as in claim 1, wherein said substrate is made of a material selected from a group consisting of $Al_2O_3$ and $FR_4$.

3. The low pass filter as in claim 1, wherein said first, second, and third dielectric layers are formed with benzocyclobutene.

4. The low pass filter as in claim 1, wherein said first, second, and third metallic pattern layers are formed with gold.

* * * * *